US006957869B1

(12) United States Patent
Sawtelle

(10) Patent No.: US 6,957,869 B1
(45) Date of Patent: Oct. 25, 2005

(54) ROAD MARKING REMOVAL SYSTEM

(76) Inventor: Randy R. Sawtelle, 12341 Ruffed Grouse Rd., Weeki Wachi, FL (US) 34614-1918

( * ) Notice: Subject to any disclaimer, the term of this patent is extended or adjusted under 35 U.S.C. 154(b) by 0 days.

(21) Appl. No.: 10/831,838

(22) Filed: Apr. 26, 2004

Related U.S. Application Data

(63) Continuation-in-part of application No. 10/287,763, filed on Nov. 4, 2002, now abandoned.

(60) Provisional application No. 60/337,799, filed on Nov. 7, 2001.

(51) Int. Cl.[7] ..... E01H 1/00
(52) U.S. Cl. ..... 299/36.1; 299/14; 37/407; 15/93.1
(58) Field of Search ..... 299/36.1, 37.1, 299/14; 37/407; 15/93.1

(56) References Cited

U.S. PATENT DOCUMENTS 2,805,906 A * 9/1957 Humphries et al. ..... 108/129
2,864,184 A * 12/1958 Fohr ..... 37/404
3,942,271 A * 3/1976 George ..... 37/404
4,146,635 A * 3/1979 Eigenmann ..... 404/12
4,584,044 A * 4/1986 Tokunaga et al. ..... 404/94
5,033,144 A * 7/1991 Ganon ..... 12/142 G
5,641,206 A * 6/1997 Craft ..... 299/37.1

* cited by examiner

*Primary Examiner*—John Kreck
(74) *Attorney, Agent, or Firm*—Louis J. Brunoforte

(57) ABSTRACT

A bucket razor body has a coupling end and a scraping end facing away from the bucket. The coupling end has an upper and lower wall with a slot between the walls. The upper wall has threaded apertures with associated bolts for releasably coupling to front end loader equipment. The scraping end of the bucket razor body has an upper and lower. A slot is formed between the surfaces. Laterally aligned threaded apertures with seven associated bolts extending through the apertures. A scraping blade is formed with an interior end. The interior end is positionable within the slot. An exterior razor-like end extends from the slit to an elevation below the lower surface and lower wall to scrape road markings from a hard surface.

2 Claims, 7 Drawing Sheets

14
10
16
54
24
56
60
20
22
18

ROAD MARKING REMOVAL SYSTEM

RELATED APPLICATIONS

The present patent application is a continuation-in-part of U.S. patent application Ser. No. 10/287,763 filed Nov. 4, 2002, now abdn., which in turn is based upon Provisional Patent Application 60/337,799 filed Nov. 7, 2001.

BACKGROUND OF THE INVENTION

1. Field of the Invention

The present invention relates generally to the removal of objects stuck to a hard surface, such as, but not limited to, temporary and permanent marking tapes, here after known as (PMT), raised pavement marking reflectors, here after referred to as (RPM), ceramic marking buttons, here by known as (CMB), more particularly, to efficient methods and tools for removing a variety of objects that are adhered or stuck to a hard surface using a variety of mastics.

The marking tapes (PMT) are commonly used on both highways and parking lots. They are used both to divert traffic in a temporary fashion on highways, as well as, to serve as permanent markings. They are designed to withstand a large variety of attacks: weather, traffic, time to mention a few. They are held to the surface by mastic. Each company's product uses a different formula for this mastic, but all have the goal with these markings, which is to make them durable.

There is a need for efficient removal of these tapes (PMT) at various times. Due to new traffic patterns or just simply worn out markings. In view of the permanent nature of these products they do not come off easily. Even the so-called temporary PMT is likely to come apart, rather than let go of the surface. This proves to make it a very time consuming and labor intensive operation. Usually performed by pulling by hand or attaching it to the back of a truck. The difficulty comes when the tape starts to come apart, which is normal. It is not uncommon for it to come up in strips of no more than an inch in width and long, sometimes even less. When the PMT has been run over a lot or is applied in a hot climate this again intensifies its adhesion to the surface. This necessitates taking the remaining PMT off with putty knives and razor blades one little piece at a time. This is a universal problem with removing PMTs.

Water blasting has been tried. This takes the tape off but tends to turn it into even smaller strips and splatters the tape all over the roadway and any nearby objects. When dry it is stuck again to the road surface and everything else. As it is made to reflect light, it is really confusing at night as a whole area may appear to be painted the PMTs color and can and does confuse the motoring public. It also leaves a misleading mark in the form of un-removed mastic.

Another method is grinding. Although this does remove the PMT it also cuts it in to small pieces. This method also does a certain amount of damage to the surface. This damage is unacceptable to the department of transportation for many reasons. One of the main reasons is it leaves a misleading mark on the road surface. All these methods leave a mess on the road way as well as putting workers in harms way for a long period of time. It is very dangerous for the traveling public as they drive through the areas where this work is being done.

Raised Pavement Markers (RPM) are commonly used in the warmer climates. It embodies a 2 inch×4 inch or a 4 inch×4 inch stick on reflector to the road surface. It normally comes in traffic yellow and white. And sometimes blue is used to identify were fire hydrants are. These RPMs are applied to the surface in 3 main ways. One is hot bituminous application. The bituminous is heated to 425 degrees and put down hot on the surface and before it cools off the RPM is stuck in it. Another method is using epoxies. After the epoxy is applied to the surface the RPM is stuck in it. Another is sticky pads, that uses a combination of either a sticky mastic or a heat-able pad.

These are used in a variety of ways: to delineate the centerline, edge line or even a traffic island. They are used in some states as the only pavement marking to divert traffic in a temporary and permanent traffic patterns.

When used in a temporary fashion they have to be removed when traffic is switched to the permanent pattern. This is commonly done by a claw type hammer and some times a chisel. This is very time consuming and dangerous. As often as not you are in the middle of two lanes of traffic bent over swinging a hammer. This method does not get all the mastic off. So it leaves a big black puddle of mastic on the road surface, which can mislead the traveling public. Most states now require this mastic to be removed as well, for this reason.

You can also remove them with a grinder. This works well but tends to shatter the RPM and can fling shards out into traffic as well as possible damage to the road surface. You can use a motor grader blade. The problem here is traffic interference and the fact that it often does a lot of damage to the paved surface. All these methods work in a limited way. They all leave debris on the road surface as well as misleading marks and some of them even damage the road surface.

Ceramic Buttons (CMB) are used in some of the same ways as the RPM. In many western states it is used in place of the centerline markings whether they are the white line or the yellow. They do not have any reflective capabilities so they are usually used in conjunction with RPMs. The CMBs tend to get driven into the surface by traffic so this makes them very hard to remove. They are applied in all the same ways as the RPMs. They are harder to get off the surface. They tend to shatter more readily than RPMs so flying shards are a big danger. Again in all these cases the PMT, RPMs and the CMB removal is done mostly by hand by a walking worker with a hammer and or chisel. Some times they use go-carts or low cars with out doors to get between each marking. All in all very labor intensive and highly dangerous work due to the long exposure time to working in moving traffic.

The present invention thus relates to a road marking removal system and more particularly pertains to scraping road markings such as temporary and permanent marking tapes, raised pavement marking reflectors, ceramic marking buttons and the like from hard surfaces such as highway asphalt, concrete and the like.

2. Description of the Prior Art

The use of highway maintenance systems of known designs and configurations is known in the prior art. More specifically, highway maintenance systems of known designs and configurations previously devised and utilized for the purpose of removing road tape and markings through conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,765,109 issued Oct. 16, 1973 to Daviduke relates to a scraping blade for converting a cutting edge on a loading bucket. U.S. Pat. No.

3,942,271 issued Mar. 9, 1976 to George relates to a backhoe attachment. U.S. Pat. No. 5,467,498 issued Nov. 21, 1995 to Keegan relates to a self-sharpening scraping tool. U.S. Pat. No. 6,042,299 issued Mar. 28, 2000 to Cooper relates to apparatus for removal and collection of roadway markings. Lastly, U.S. Pat. No. 6,174,104 issued Jan. 16, 2001 to Fields relates to a highway marking tape removal apparatus.

While these devices fulfill their respective, particular objectives and requirements, the aforementioned patents do not describe a road marking removal system that allows scraping road markings such as temporary and permanent marking tapes, raised pavement marking reflectors, ceramic marking buttons and the like from hard surfaces such as highway asphalt, concrete and the like.

In this respect, the road marking removal system according to the present invention substantially departs from the conventional concepts and designs of the prior art, and in doing so provides an apparatus primarily developed for the purpose of scraping road markings such as temporary and permanent marking tapes, raised pavement marking reflectors, ceramic marking buttons and the like from hard surfaces such as highway asphalt, concrete and the like.

Therefore, it can be appreciated that there exists a continuing need for a new and improved road marking removal system which can be used for scraping road markings such as temporary and permanent marking tapes, raised pavement marking reflectors, ceramic marking buttons and the like from hard surfaces such as highway asphalt, concrete and the like. In this regard, the present invention substantially fulfills this need.

SUMMARY OF THE INVENTION

In view of the foregoing disadvantages inherent in the known types of highway maintenance systems of known designs and configurations now present in the prior art, the present invention provides an improved road marking removal system. As such, the general purpose of the present invention, which will be described subsequently in greater detail, is to provide a new and improved road marking removal system and method which has all the advantages of the prior art and none of the disadvantages.

To attain this, the present invention essentially comprises a front-end loader piece of equipment. The equipment is selected from the class of front-end loader pieces of equipment. The class includes skid steer tractors, backhoes and farm tractors. Such equipment has a bucket. The bucket has a bucket plate. The bucket plate is adjustably positionable in a horizontal plane. The bucket plate has an upper face, a lower face and an end edge. The end edge has a first width.

A bucket razor body is provided. The bucket razor body has a coupling end. The coupling end faces the bucket. The bucket razor body has a scraping end. The scraping end faces away from the bucket. The razor bucket body has a second width less than half that of the first width. The coupling end of the razor bucket body has an upper horizontal wall and a lower horizontal wall. A slot is provided between the walls. In this manner the bucket plate is received. The upper wall has four vertically extending threaded apertures. The apertures are provided in a rectangular configuration. Four associated bolts extend through the apertures. In this manner the bucket razor body is releasably coupled to the bucket plate.

The scraping end of the bucket razor body has an upper surface. The upper surface extends rearwardly as an extension of the upper wall but at an angle of about 15 degrees. The scraping end of the bucket razor body also has a lower surface. The lower surface extends rearwardly as an extension of the lower wall. A slot is formed in the scraping end between the surfaces parallel with the upper surface. Seven laterally aligned threaded apertures are provided. The apertures extend through the upper surface to the slot. Seven associated bolts extend through the apertures. Provided next are two laterally spaced horizontal handles. The handles extend upwardly from the upper wall laterally exterior of the four threaded apertures. Two laterally spaced angled handles are also provided. The angled handles extend upwardly from the upper surface laterally exterior of the seven threaded apertures.

Further provided is a scraping blade. The scraping blade is formed with an interior end. The scraping blade is positionable within the slot. The scraping blade is releasably secured by the seven bolts. The scraping blade has an exterior razor-like end. The exterior end extends from the slit to an elevation below the lower surface. A lower wall is provided. The lower wall scrapes road markings from a hard surface.

Provided last is a heater assembly. The heater assembly has an arm. The arm has a distal end and a proximal end. The heater assembly has a triangular latch with laterally spaced coupling members. The latch couples the heater assembly to the razor body about a horizontal axis.

The heater assembly has a first radiant heater. The first radiant heater has a distal end and a proximal end. The proximal end is coupled to the distal end of the arm about a vertical axis.

The heater assembly has a second radiant heater. The second radiant heater has a distal end and a proximal end. The proximal end is coupled to the distal end of the first radiant heater about a vertical axis. The first radiant heater has a pair of laterally disposed wheels. The wheels are provided at an intermediate extent. In this manner the wheels of the first radiant heater may be rotated about a horizontal axis and a vertical axis. The second radiant heater has a wheel. The wheel is provided at its distal end. In this manner the second radiant heater may be rotated about a horizontal axis and a vertical axis. Solar panels are provided. Each solar panel is located above an associated radiant heater. The solar panels energize the electronic components for controlling the radiant heaters for rendering the road markings more susceptible to being scraped from its hard surface.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved road marking removal system which has all of the advantages of the prior art highway maintenance systems of known designs and configurations and none of the disadvantages.

It is another object of the present invention to provide a new and improved road marking removal system which may be easily and efficiently manufactured and marketed.

It is further object of the present invention to provide a new and improved road marking removal system which is of durable and reliable constructions.

An even further object of the present invention is to provide a new and improved road marking removal system which is susceptible of a low cost of manufacture with regard to both materials and labor, and which accordingly is then susceptible of low prices of sale to the consuming public, thereby making such road marking removal system economically available to the buying public.

Even still another object of the present invention is to provide a road marking removal system for scraping road markings such as temporary and permanent marking tapes, raised pavement marking reflectors, ceramic marking buttons and the like from hard surfaces such as highway asphalt, concrete and the like.

Lastly, it is an object of the present invention to provide a new and improved road marking removal system. A bucket razor body has a coupling end and a scraping end facing away from the bucket. The coupling end has an upper and lower wall with a slot between the walls. The upper wall has threaded apertures with associated bolts for releasably coupling to front end loader equipment. The scraping end of the bucket razor body has an upper and lower. A slot is formed between the surfaces. Laterally aligned threaded apertures with seven associated bolts extending through the apertures. A scraping blade is formed with an interior end. The interior end is positionable within the slot. An exterior razor-like end extends from the slit to an elevation below the lower surfaced and lower wall to scrape road markings from a hard surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
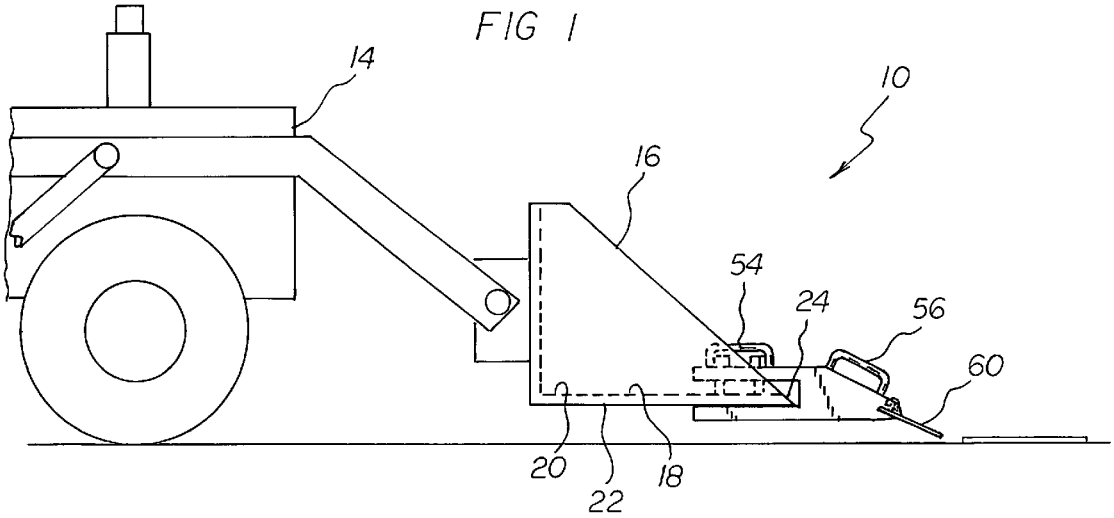
FIG. 1 is a side elevational view of a road marking removal system constructed in accordance with the principles of the present invention.
Figure 2:
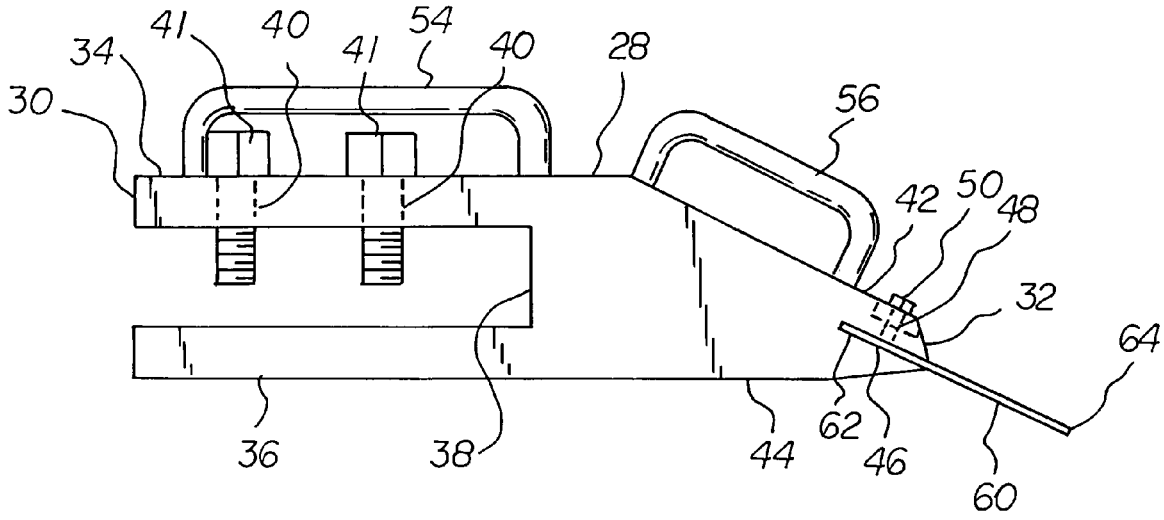
FIG. 2 is an enlarged side elevational view of the bucket razor body and razor shown in FIG. 1.
Figure 3:
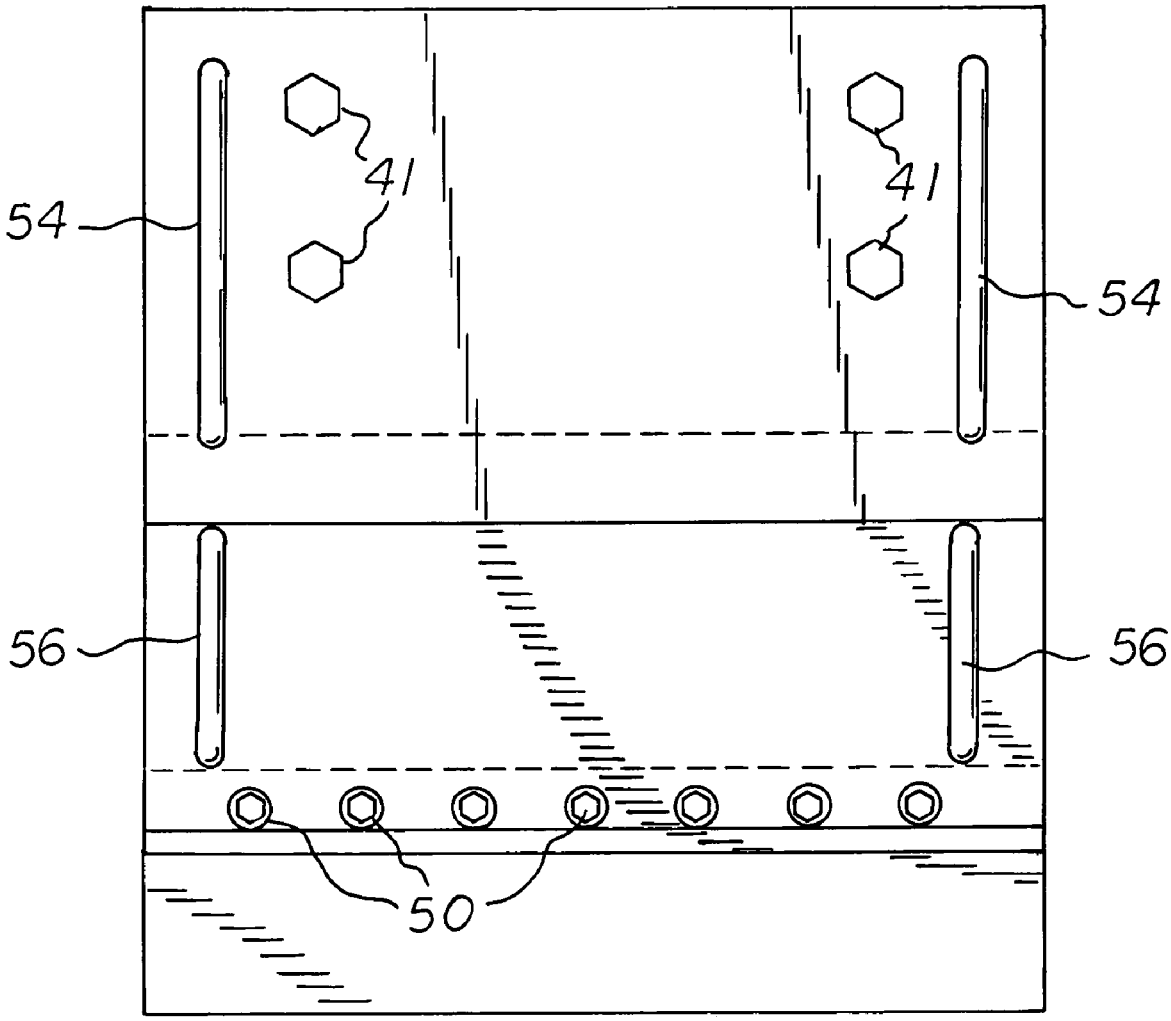
FIG. 3 is a plan view of the bucket razor body and razor shown in FIG. 2.

With reference now to the drawings, and in particular to FIG. 1 thereof, the preferred embodiment of the new and improved road marking removal system embodying the principles and concepts of the present invention and generally designated by the reference numeral 10 will be described.

The present invention, the road marking removal system 10 is comprised of a plurality of components. Such components in their broadest context include a bucket razor body and a scraping blade. Such components are individually configured and correlated with respect to each other so as to attain the desired objective.

First provided is a front-end loader piece of equipment 14. The equipment is selected from the class of front-end loader pieces of equipment. The class includes skid steer tractors, backhoes and farm tractors. Such equipment has a bucket 16. The bucket has a bucket plate 18. The bucket plate is adjustably positionable in a horizontal plane. The bucket plate has an upper face 20, a lower face 22 and an end edge 24. The end edge has a first width.

A bucket razor body 28 is provided. The bucket razor body has a coupling end 30. The coupling end faces the bucket. The bucket razor body has a scraping end 32. The scraping end faces away from the bucket. The razor bucket body has a second width less than half that of the first width.

The coupling end of the razor bucket body has an upper horizontal wall 34 and a lower horizontal wall 36. A slot 38 is provided between the walls. In this manner the bucket plate is received. The upper wall has four vertically extending threaded apertures 40. The apertures are provided in a rectangular configuration. Four associated bolts extend through the apertures. In this manner the bucket razor body is releasably coupled to the bucket plate.

The scraping end of the bucket razor body has an upper surface 42. The upper surface extends rearwardly as an extension of the upper wall but at an angle of about 15 degrees. The scraping end of the bucket razor body also has a lower surface 44. The lower surface extends rearwardly as an extension of the lower wall. A slot 46 is formed in the scraping end between the surfaces parallel with the upper surface. Seven laterally aligned threaded apertures 48 are provided. The apertures extend through the upper surface to the slot. Seven associated bolts 50 extend through the apertures. In order to accommodate thinner razors, one or more shims may be utilized in the slot for insuring a secure coupling of the razor to the bucket razor.

Provided next are two laterally spaced horizontal handles 54. The handles extend upwardly from the upper wall laterally exterior of the four threaded apertures. Two laterally spaced angled handles 56 are also provided. The angled handles extend upwardly from the upper surface laterally exterior of the seven threaded apertures.

Further provided is a scraping blade 60. The scraping blade is formed with an interior end 62. The scraping blade is positionable within the slot. The scraping blade is releasably secured by the seven bolts. The scraping blade has an exterior razor-like end 64. The exterior end extends from the slit to an elevation below the lower surface. A lower wall is provided. The lower wall scrapes road markings from a hard surface.

Provided last is a heater assembly 68. The heater assembly has an arm 70. The arm has a distal end 72 and a proximal end 74. The heater assembly has a triangular latch 76 with laterally disposed coupling members. The latch couples the heater assembly to the razor body about a horizontal axis.

The heater assembly has a first radiant heater 78. The first radiant heater has a distal end 80 and a proximal end 82. The proximal end is coupled to the distal end of the arm about a vertical axis.

The heater assembly has a second radiant heater 84. The second radiant heater has a distal end 86 and a proximal end 88. The proximal end is coupled to the distal end of the first radiant heater about a vertical axis. The first radiant heater has a pair of laterally spaced wheels 90. The wheels are provided at an intermediate extent. In this manner the wheels of the first radiant heater may be rotated about a horizontal axis and a vertical axis. The second radiant heater has a wheel 92. The wheel is provided at its distal end. In this manner the second radiant heater may be rotated about a horizontal axis and a vertical axis. Tho solar panels 94 are provided. The solar panels are located above the radiant heaters. The solar panel energizes the electronic components for the radiant heaters. A pair of propane tanks 96 provide the thermal energy for rendering the road markings more susceptible to being scraped from its hard surface.

The present invention is for removing various items from hard surfaces. Such surfaces can be asphalt and concrete, but not limited to these. The device can be attached to and front-end loader piece of equipment, such as, but not limited to skid steer tractors, backhoes, farm tractors, any front-end loader. The unit is designed to fit a large range of different size and thickness buckets. It can, by use of setscrews, be held in place. Once unit is attached to the bucket, a cutting blade is inserted into unit. This blade also is held in place by countersunk setscrews. This blade being mainly spring steel and of such a thickness and hardness to allow it to get under and cut objects stuck to hard surfaces. Several blade widths are possible up to 16 inches. The unit itself can be positioned at any point on the bottom plate of the bucket from one side to other side. Re-moving is accomplished, by the spring steel being forced under the object, by the forward motion of the front-end loader. The angle of the unit and bucket it is mounted to, determines aggressiveness of attack.

The bucket razor, body and blade, as described above, when used in conjunction with a heater assembly, opens up a whole new process for removing several materials. Virtually anything that can be softened up by heat can be peeled from a surface such as thermoplastic pavement markings, bitumen adhered products such as reflectors or ceramic buttons, and pavement marking tapes both permanent and temporary. Additionally, the device is very effective in removing elastomeric material and fabrics from all surfaces including, but not limited to, concrete, asphalt and various other surfaces.

Thermoplastic pavement markings in the past have been removed mainly by a grinding type process that leaves the road surface damaged to some degree or by water blasting which is very costly and messy. This new technology over comes these types of problems. We are able to heat the pavement marking line only, which leaves the areas outside the line cold and hard. By the present invention, the razor bridges the hot area and does not allow the razor to dig into the surface where by it will only peel the area that is hot. The desired effect is to remove the hot line but not damage the adjacent cold surface.

It should be noted that we are trying to only soften the thermoplastic so that it can be peeled. You need to use a wider blade on the razor to accomplish the bridging effect. The only draw back to this system is it will only remove what is on the surface so if it is an open grade of asphalt, a surface with large spaces, the blade will not go down and dig these out. So the present invention really is only good for two things, a 100 percent removal on smooth or closed surfaces, 95 percent removal on open grade surfaces. Some applications require only 90 percent removal of the line so as they can repaint or thermoplastic the lines or symbols.

Bitumen is cold tar. You heat it to 423 degrees Fahrenheit and apply it to a surface and stick what ever you want into it. When it cools it will be stuck to the surface. Reflector removal is one of the features of the present invention. The problem comes when the weather is very cold and the road surface and bitumen is hard. By preheating it, the Bitumen is softened which allows the cutting off or peeling. This will remove both reflectors and ceramic buttons.

Tape removal is also a feature of the present invention. It has been found that in some instances the tape is so pounded into the surface from traffic that there is very little integrity left to the tape as a unit. The system of the present invention pre-warms the tape and makes it easier to remove it from the surface.

Other applications for the system of the present invention may be removing bumps and uneven areas; of asphalt as it will allow you to peel off the affliction. One thing which has been learned is if you put something like this in the hands of the workers, they will come up with all kinds of applications for it.

Briefly, this invention acts as a razor blade mounted to a front-end loader. It facilitates and can be employed for effective and highly acceptable removal of but not limited to the aforementioned products.

Advantageously, the bucket razor can be mounted to any front-end loader. It can be placed in any position on the bucket so as to limit amount of traffic interference. And as these types of equipment are commonly found on most projects, makes a simple and convenient way to remove the various items from hard surfaces.

The method and tool of the bucket razor will remove both the item and most, if not all, of the mastic that was holding it down. This is a greatly desired result. It removes the problem of misleading markings left behind, thus providing a smooth clean surface for new markings or surfaces to be applied without contamination from old markings or mastics. It also is designed in such a way that most removed items end up in the bucket holding the razor, thus proving to be very labor efficient and safer. As well as, providing for less time in the roadway, which allows for less motoring public hindrance and probable damage or injury, due to workers on foot present in roadway for extend amounts of time, as well as, reducing the chance of shards flying out into traffic.

The bucket razor itself is made from very heavy steel and will last indefinitely. The cutter blades are made of spring steel and are self-sharping. They are relatively inexpensive to replace. In contrast to the normally used methods of removal this is fast, self cleaning and safer for workers and the motoring public. The surface left behind is more appealing to the Department of Transportation as no misleading marks are left. It also allows for a cleaner surface, which facilitates application of and adhesion of other products. And is less labor intensive. With the ability to mount to already existing construction equipment it becomes a minor removal problem instead of a very complex one. In one embodiment, the bucket razor is 16 inch wide. This can be made of any width deemed needed without any re-engineering.

Referring first to the Figures, there is illustrated, a bucket razor apparatus according to an embodiment of the invention. The proximal end is configured to receive and attach to a plate of the bucket and distal end. It is configured to receive and to attach to a scrape plate or blade as of spring steel or the like. Specifically, the proximal end of the invention finds a bucket plate slot and a scrape plate slot for receiving the scrape plate. The bucket plate slot and the scrape plate slot are appropriately dimensioned for receiving the bucket plate and the scrape pate, respectively.

Bucket plate slot is assembled and used as follows. To mount the invention to or on the bucket, the bucket plate is inserted into the bucket plate slot. The invention is then fastened to the bucket using set crews or bolts such as a plurality of screws. Set screws or bolts are sufficiently tightened to the bucket plate so as not to allow any movement of the invention. Such buckets and associated equipment are well known to those of ordinary skill in the art and are shown in the Figures. The scrape plate is inserted into the scrape plate slot and is attached by setscrews such as a plurality of screws counter sunk as to facilitate easy movement of cut materials into the bucket. Once the invention is attached to the bucket plate and the scrape plate, the piece of construction equipment having the bucket may be positioned on a road in sufficient proximity to the highway and or surface of objects to be removed. By placing the invention appropriately on the bucket plate, you can lessen your exposure to hazards, such as, but not limited to existing traffic flow.

The embodiment shown in the Figures shows a taper or angle relative to the bottom of a bucket and or bucket plate in order to obtain a premium angle to facilitate scrape blade to cut into the objects to be removed, relative to the surface to which they are attached. The angle shown on the bottom towards the proximal end is used to facilitate proper cutting without hindrance of surface contact. The tape provides a deflection and sloped guide surface in order to move cut materials up the face of the invention and thereby ending up in the bucket. This has a dual purpose, as well as, acting as handles for easy handling of and or moving of the invention. It acts as a further guide for cut materials eventually ending up in the bucket of the front end loader. Counter sunk are a plurality of set screws or bolts to remove any hindrance of cut materials moving up and into the bucket for future disposal.

The Figures illustrate one possible configuration of the fasteners set screws or bolts. It also shows the relative configuration of the handle/guides. Once the invention is attached to the bucket plate and the scrape plate, the piece of construction equipment having the bucket may be positioned on a road or other surface in sufficient proximity to the objects to be removed. The bucket may then be manipulated such that the scrape plate is above the objects to be removed. Finally the bucket is manipulated such that the scrape plate strikes and scrapes and or cuts the objects to be removed until sufficient removal from the surface has occurred. In this way a piece of equipment traditionally available to and frequently on site-such as a front-end loader or backhoe-may be used in combination with the bucket razor of the present invention to remove objects stuck to a hard surface.

Figure 4:
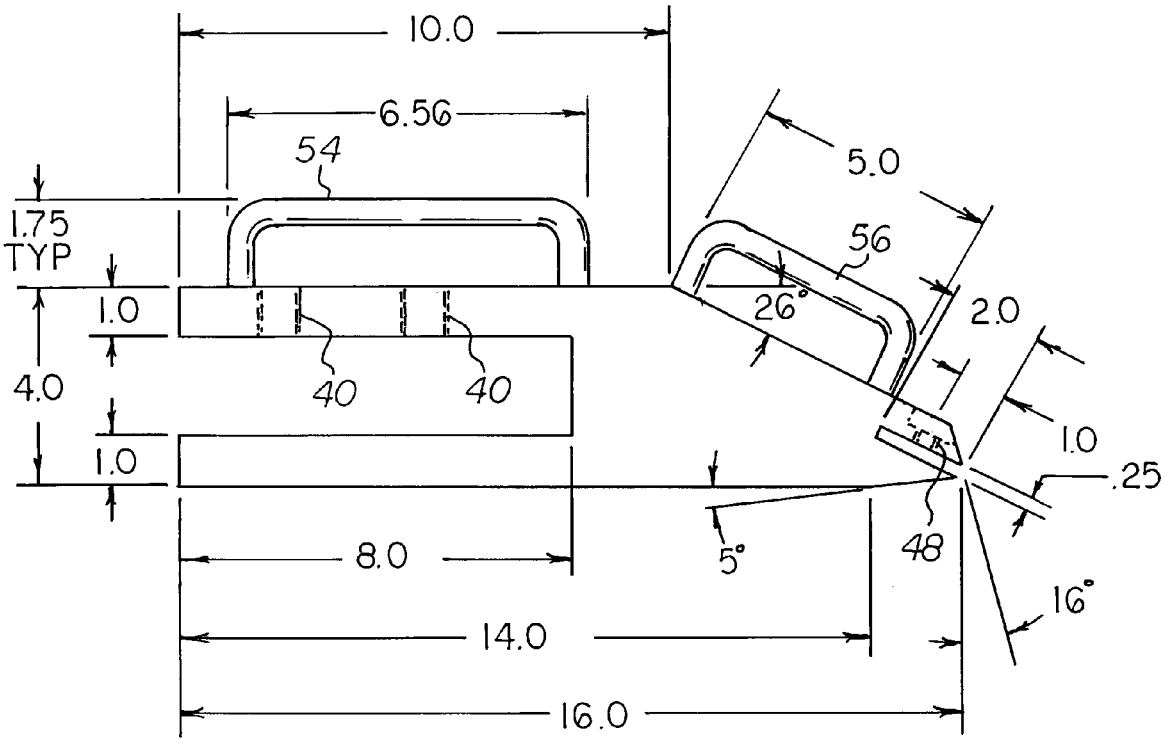
FIG. 4 is an enlarged side elevational view of the bucket razor body shown in FIG. 2 but with dimensions provided.
Figure 5:
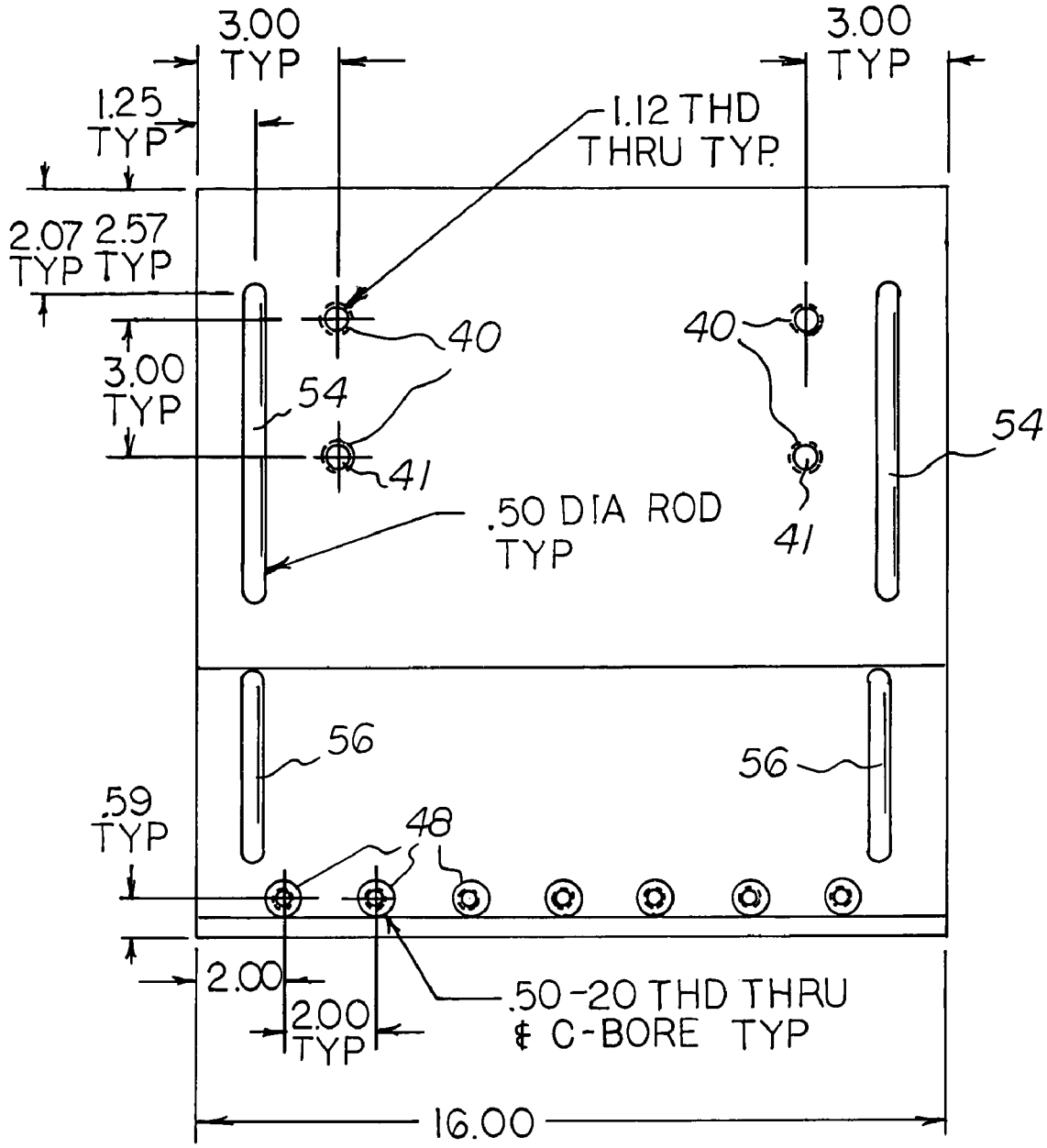
FIG. 5 is an enlarged plan view of the bucket razor body shown in FIG. 3 but with dimensions provided.
Figure 6:
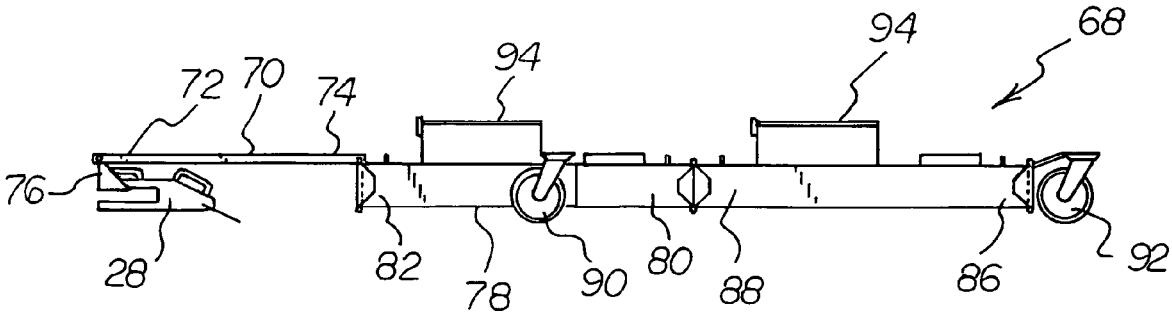
FIG. 6 is a side elevational view of a heater assembly for coupling to the bucket razor body of FIGS. 1 through 5.
Figure 7:
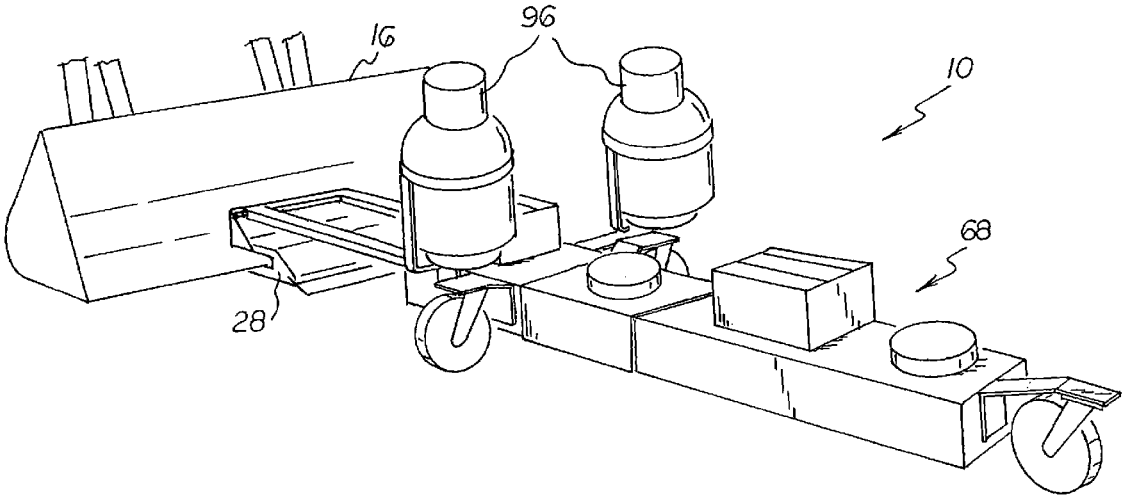
FIG. 7 is a perspective illustration of the entire system shown in the prior Figures.

FIGS. 4 and 5 illustrate one possible set of dimensions and compositions for the parts of the bucket razor apparatus of the present invention. Many other sets of dimensions and compositions may be utilized without detraction from the performance of the present invention and without exceeding the scope thereof. This is particularly true in light of the varying sizes of buckets and associated construction or maintenance equipment as well as the varying compositions and configurations of objects to be removed from hard surfaces. In one embodiment of the invention, the invention may be approximately 16 inches in length and approximately 16 inches in width. The bucket plate slot may be approximately inches deep and 16 inches wide, while the scrape plate slot may be approximately 16 inches long and 2 inches deep. The bucket plate slot may be approximately 2 inches high, while the scrape plate slot may be approximately ⅛ inch to ¼ inch high.

The proximal end of the invention may be approximately 4 inches high, with the bucket plate slot 15 defined therein by two walls, each of the walls being approximately 1 inch high. The fastener used to attach the invention to the bucket plate may be a plurality of screws with shanks approximately ⅛ inch in diameter, the fastener used to attach the bracket to the scrape plate may be a plurality of screws with shanks approximately ½ inch. The invention may be composed of steel or another suitably durable and rigid material for functioning as described above.

An apparatus and method for removing objects stuck to hard surfaces with various mastics is described above. Various details of the invention may be changed without departing from its scope. Furthermore, the foregoing description of the specific embodiments of the invention and the best mode for practicing the invention are provided for the purpose of illustration only and not for the purpose of limitation.

The heating part of the system is not a new technology. It has been used in several different forms to heat asphalt in order to do repairs or what is called street stamping. Up until the present system, these have been the primary uses for this technology. There are many different types of heaters. One is infrared and the other is radiant. We are using the radiant type because of its even heating capabilities.

The preferred product is made by Asphalt Reheat Systems, Inc., herein after ARS. Such product is good to work with.

ARS units use radiant blue-flame technology, which is a type of heat applied to the asphalt surface that is superior to the standard infrared heaters. This rolling blue flame system was developed to specifically help eliminate overheating and burning of the asphalt. The heaters are considered by many who have used them as the most versatile units on the market. ARS currently builds heaters that can be used on any type of patching or repair work as well as all stamped asphalt applications.

These are the smallest heating units on the market and not to mention the lightest, a mere 65 lbs. The 1×4 units are also available in the split channel version if you have very small areas that you are regularly fixing. The heating times and fuel consumption are slightly less than the other portables with this unit. The 1×4 heaters are exceptionally good for smoothing joints to a seamless patch, fixing drainage problems, erasing tire indentations as well as printing borders.

We are using two units hooked together to provide a faster liner moving operation. We have mounted the tanks to the sides to allow for better visibility. The controls are on a longer cable that can be placed in side the skid steer or other tractor device that is being used to push the system. We also changed the wheels on the units to be caster swivel type, to allow it to be driven easier.

The units use propane as a fuel source. It is controlled by a regulator system in conjunction with thermo coupler and static electric igniter. A small 12 volt battery is used to power the automatic propane flow control. It opens and shuts in order to allow the propane to flow to the burning area or not. This is a 12 volt valve. The battery comes complete with a trickle charging system that can be plugged in at night, as well as an auxiliary solar system that keeps the unit charged up during operations. We use two propane bottles, one for each unit.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A road marking removal system for scraping road markings such as temporary and permanent marking tapes, raised pavement marking reflectors, ceramic marking buttons and the like from hard surfaces such as highway asphalt, concrete and the like comprising, in combination:

a front-end loader piece of equipment selected from the class of front-end loader pieces of equipment including skid steer tractors, backhoes and farm tractors, such equipment having a bucket with a bucket plate adjustably positionable including positionable in a horizontal plane, the bucket plate having an upper face and a lower face and an end edge, the end edge having a first width;

a bucket razor body having a coupling and facing the bucket and a scraping end facing away from the bucket, the razor bucket body having a second width less than half that of the first width, the coupling end of the razor bucket body having an upper horizontal wall and a lower horizontal wall with a slot between the walls for receiving the bucket plate, the upper wall having four vertically extending threaded apertures in a rectangular configuration with four associated bolts extending there through for releasably coupling the bucket razor body to the bucket plate, the scraping end of the bucket razor body having an upper surface extending rearwardly as an extension of the upper wall but at an angle of about 15 degrees and a lower surface extending rearwardly as an extension of the lower wall with a slot formed in the scraping end between the surfaces parallel with the upper surface, seven laterally aligned threaded apertures extending through the upper surface to the slot with seven associated bolts extending through;

two laterally spaced horizontal handles extending upwardly from the upper wall laterally exterior of the four threaded apertures and two laterally spaced angled handles extending upwardly from the upper surface laterally exterior of the seven threaded apertures;

a scraping blade formed with an interior end positionable within the slot and releasably secured by the seven bolts and an exterior razor-like end extending from the slit to an elevation below the lower surface and lower wall to scrape road markings from a hard surface; and a heater assembly having an arm with a distal end and a proximal and with a triangular latch coupling the heater assembly to the razor body about a horizontal axis, the heater assembly having a first radiant heater with a distal end and a proximal end coupled to the distal end of the arm about a vertical axis, the heater assembly having a second radiant heater with a distal end and a proximal end coupled to the distal end of the first radiant heater about a vertical axis, the first radiant heater having a pair of laterally disposed wheels at an intermediate extent for rotation about a horizontal axis and a vertical axis, the second radiant heater having a wheel at its distal end for rotation about a horizontal axis and a vertical axis, a solar panel located above each radiant heater to energize electronic components for controlling the radiant heaters with laterally disposed propane tanks for rendering the road markings more susceptible to being scraped from its hard surface.

2. A road marking removal system comprising:

a bucket razor body having a coupling end and a scraping end facing away from the bucket, the coupling end having an upper and lower wall with a slot between the walls, the upper wall having threaded apertures with associated bolts for releasably coupling to front end loader equipment, the scraping end of the bucket razor body having an upper and lower surface with a slot formed between the surfaces and with laterally aligned threaded apertures with seven associated bolts extending through;

a scraping blade formed with an interior end positionable within the slot and an exterior razor-like end extending from the slit to an elevation below the lower surface and lower wall to scrape road markings from a hard surface; and a heater assembly having an arm with distal end and a proximal end coupling the heater assembly to the razor, the heater assembly having a heater and a wheel at its distal end for rotation about a horizontal axis and a vertical for rendering the road markings.

* * * * *